US006365547B1

(12) United States Patent
Foster et al.

(10) Patent No.: US 6,365,547 B1
(45) Date of Patent: Apr. 2, 2002

(54) DYE-DONOR ELEMENT WITH TRANSFERABLE PROTECTION OVERCOAT

(75) Inventors: David G. Foster, West Henrietta; Maurice L. Gray, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/745,717

(22) Filed: Dec. 21, 2000

(51) Int. Cl.[7] ..... B41M 5/035; B41M 5/38

(52) U.S. Cl. ..... 503/227; 428/195; 428/913; 428/914

(58) Field of Search ..... 8/471; 428/195, 428/913, 914; 503/227

(56) References Cited

U.S. PATENT DOCUMENTS 4,621,271 A 11/1986 Brownstein ..... 346/76 PH
5,322,832 A 6/1994 Takeyama et al. ..... 503/227

*Primary Examiner*—Bruce H. Hess
(74) *Attorney, Agent, or Firm*—Harold E. Cole

(57) ABSTRACT

A dye-donor element for thermal dye transfer comprising a support having thereon at least one dye layer area comprising an image dye in a binder and another area comprising a transferable protection layer, the transferable protection layer area being approximately equal in size to the dye layer area, wherein the transferable protection layer comprises a binder and a UV-absorber comprising an oxide of antimony.

18 Claims, No Drawings

DYE-DONOR ELEMENT WITH TRANSFERABLE PROTECTION OVERCOAT

FIELD OF THE INVENTION

This invention relates to a dye-donor element for thermal dye transfer, and more particularly to the use of a transferable protection overcoat in the element for transfer to a thermal print to provide protection from fading due to light exposure.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. This is due to dye being at the surface of the dye-receiving layer of the print. These dyes can be driven further into the dye-receiving layer by thermally fusing the print with either hot rollers or a thermal head. This will help to reduce dye retransfer and fingerprint susceptibility, but does not eliminate these problems. However, the application of a protection overcoat will practically eliminate these problems. This protection overcoat is applied to the receiver element by heating in a likewise manner after the dyes have been transferred. The protection overcoat will improve the stability of the image to fading from light exposure and oil from fingerprints.

The protection overcoat must adhere strongly to the top layer of the receiver element so that no imperfections exist in the transferred layer that can be observed without magnification. One such imperfection resulting from the lack of adhesion of the protection overcoat to the receiver surface is the presence of small voids or air bubbles. Bubbles are created if the temperature during transfer of the protection overcoat layer does not go above the Tg of the protection overcoat material, resulting in inadequate adhesion as the donor substrate is stripped away from the receiver.

U.S. Pat. No. 5,322,832 relates to a thermal dye transfer image-receiving element with a transferable protection overcoat containing an inorganic oxide, such as titanium dioxide or tin oxide. However, there is a problem with these materials in that the protection they provide from UV rays is not as good as one would like.

It is the object of this invention to provide a dye-donor element which contains a transferable protection layer which is capable of absorbing UV rays.

SUMMARY OF THE INVENTION

These and other objects are achieved in accordance with this invention which relates to a dye-donor element for thermal dye transfer comprising a support having thereon at least one dye layer area comprising an image dye in a binder and another area comprising a transferable protection layer, the transferable protection layer area being approximately equal in size to the dye layer area, wherein the transferable protection layer comprises a binder and a UV-absorber comprising an oxide of antimony.

By use of the invention, a thermal dye transfer print is obtained which has excellent protection from UV rays.

DETAILED DESCRIPTION OF THE INVENTION

In a preferred embodiment of the invention, the dye-donor element is a multicolor element comprising repeating color patches of yellow, magenta and cyan image dyes, respectively, dispersed in a binder, and a patch containing the protection layer.

In another embodiment of the invention, the protection layer is the only layer on the donor element and is used in conjunction with another dye-donor element which contains the image dyes.

In another preferred embodiment of the invention, the dye-donor element is a monochrome element and comprises repeating units of two areas, the first area comprising a layer of one image dye dispersed in a binder, and the second area comprising the protection layer.

In another preferred embodiment of the invention, the dye-donor element is a black-and-white element and comprises repeating units of two areas, the first area comprising a layer of a mixture of image dyes dispersed in a binder to produce a neutral color, and the second area comprising the protection layer.

The present invention provides a protection overcoat layer on a thermal print by uniform application of heat using a thermal head. After transfer to the thermal print, the protection layer provides superior protection against image deterioration due to exposure to light, common chemicals, such as grease and oil from fingerprints, and plasticizers from film album pages or sleeves made of poly(vinyl chloride). The protection layer is generally applied at a coverage of at least about 0.03 $g/m^2$ to about 1.5 $g/m^2$ to obtain a dried layer of less than 1 $\mu$m.

As noted above, the UV-absorber employed in the invention comprises an oxide of antimony. While any such oxide can be used, antimony pentoxide is preferred.

As noted above, the transferable protection layer comprises a UV-absorber dispersed in a binder, such as a polymeric binder. Many such polymeric binders have been previously disclosed for use in protection layers. Examples of such binders include those materials disclosed in U.S. Pat. No. 5,332,713, the disclosure of which is hereby incorporated by reference. In a preferred embodiment of the invention, poly(vinyl acetal) is employed.

In a preferred embodiment of the invention, inorganic particles are used in the protection layer. Examples of useful inorganic particles include, for example, silica, titania, alumina, antimony oxide, clays, calcium carbonate, talc, etc. as disclosed in U.S. Pat. No. 5,387,573. In a preferred embodiment of the invention, the inorganic particles are divinyl benzene. The inorganic particles improve the separation of the laminated part of the protection layer from the unlaminated part upon printing.

In a preferred embodiment of the invention, the protection layer contains from about 5% to about 60% by weight inorganic particles, from about 25% to about 60% by weight polymeric binder and from about 2% to about 60% by weight of antimony pentoxide.

In use, yellow, magenta and cyan dyes are thermally transferred from a dye-donor element to form an image on the dye-receiving sheet. The thermal head is then used to transfer the clear protection layer, from another clear patch on the dye-donor element or from a separate donor element, onto the imaged receiving sheet by uniform application of heat. The clear protection layer adheres to the print and is released from the donor support in the area where heat is applied.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

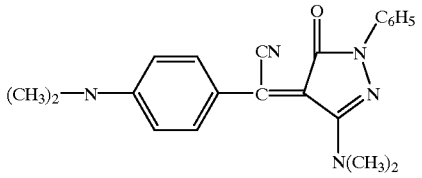

(magenta)

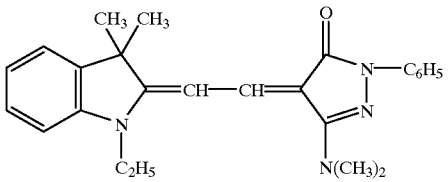

(yellow)

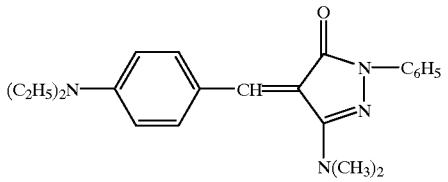

(yellow)

-continued

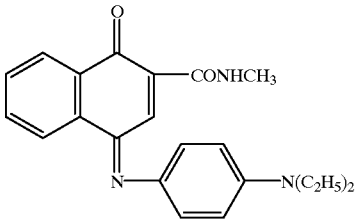

(cyan)

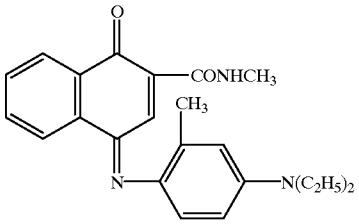

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

A slipping layer may be used on the back side of the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly-caprolactone, silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly (vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper, cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image. After the dye image is transferred, the protection layer is then transferred on top of the dye image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head FTP-040 MCSOO1, a TDK Thermal Head LV5416 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

The following example is provided to illustrate the invention.

EXAMPLE

Element 1 of the Invention

Protection layer donor elements were prepared by coating on the back side of a 6 $\mu$m poly(ethylene terephthalate) support:

1) a subbing layer of titanium alkoxide (DuPont Tyzor TBT)® (0.13 g/m$^2$) from a n-propyl acetate and n-butyl alcohol solvent mixture (85/15), and 2) a slipping layer containing an aminopropyl-dimethyl-terminated polydimethylsiloxane, PS513® (United Chemical Technologies) (0.01 g/m$^2$), a poly(vinyl acetal) binder (0.38 g/m$^2$) (Sekisui KS-1), p-toluenesulfonic acid (0.0003 g/m$^2$) and candellila wax (0.02 g/m$^2$) coated from a solvent mixture of diethylketone, methanol and distilled water (88.7/9.0/2.3).

The front side of the donor element was coated with a protection layer of a binder of poly(vinyl acetal), 0.58 g/m$^2$, (Sekisui KS-10); divinyl benzene beads, 0.05 g/m$^2$; antimony pentoxide (Nissan Chemical Co.), 0.38 g/m$^2$; dissolved in a mixture of diethyl ketone and methanol (75:25).

Control Element C-1

This element was prepared the same as Element 1 of the invention except that a colloidal silica, IPA-ST, (Nissan Chemical Co.) was used instead of antimony pentoxide at the same concentration.

Control Element C-2

This element was prepared the same as Element 1 of the invention except that a metal oxide dispersion of titanium dioxide, zirconium oxide and tin oxide (Nissan Chemical Co.) was used instead of antimony pentoxide at the same concentration.

Receiving Element

A thermal dye-transfer receiving element was prepared by coating the following layers in order onto a support of an OPPalyte® polypropylene laminated paper support as described in U.S. Pat. Nos. 5,858,916 and 5,858,919:

a) a subbing layer of Prosil® 221 (aminopropyltriethoxysilane) and Prosil® 2210 (aminofunctional epoxysilane) (PCR, Inc.) (1:1 weight ratio) and LiCl (0.0022 g/m$^2$) in an ethanol-methanol-water solvent mixture. The resultant solution (0.10 g/m$^2$) contained approximately 1% of silane component, 3% water, and 96% of 3A alcohol;

b) a dye-receiving layer containing Makrolon® KL3-1013 (a polyether-modified bisphenol-A polycarbonate block copolymer (Bayer AG) (1.52 g/m$^2$, Lexan® 141-112 bisphenol-A polycarbonate (General Electric Co.) (1.24 g/m$^2$), Fluorad® FC-431 a perfluorinated alkylsulfonamidoalkylester surfactant (3M Co.) (0.01 g/m$^2$), Drapex® 429 polyester plasticizer (Witco Corp.) (0.23 g/m$^2$), 8 $\mu$m crosslinked poly(styrene-co-butyl acrylate-co-divinylbenzene) elastomeric beads (Eastman Kodak Co.) (0.006 g/m$^2$) and diphenyl phthalate (0.46 g/m$^2$ coated from dichloromethane; and c) a dye-receiver overcoat coated from a solvent mixture of methylene chloride and trichloroethylene containing a polycarbonate random terpolymer of bisphenol-A (50 mole-%), diethylene glycol (49 mole-%), and polydimethylsiloxane (1 mole-%) (2,500 MW) block units (0.55 g/m$^2$; a bisphenol A polycarbonate modified with 50 mole-% diethylene glycol (2,000 MW) (0.11 g/$^2$); Fluorad® FC-431 surfactant (0.022 g/m$^2$); and DC-510® surfactant (Dow Corning Corp.) (0.003 g/m$^2$). Polycarbonates used:

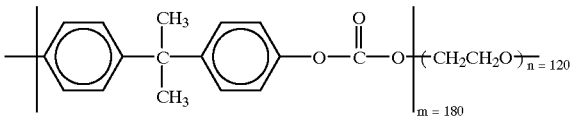

KL3-1013, block copolymer of polyether glycol and bisphenol A polycarbonate (Bayer AG)

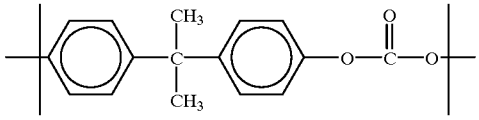

Bisphenol A polycarbonate Lexan 141® (General Electric Company)

Printing

A neutral density image with a maximum density of at least 2.3 was printed on a Kodak 8650 Thermal Printer. The presence of poor adhesion of a protection overcoat is more apparent with a high-density black image.

The dye donor element having a protection layer was placed in contact with the polymeric receiving layer side of the receiver element containing the neutral density image described above. The assemblage was positioned on an 18 mm platen roller and a TDK thermal head (No. 3K0345) with a head load of 62 Newtons was pressed against the platen roller. The TDK 3K0345 thermal print head has 2560 independently addressable heaters with a resolution of 300 dots/inch and an average resistance of 3314Ω. The imaging electronics were activated when an initial print head temperature of 36.4° C. had been reached.

The assemblage was drawn between the printing head and platen roller at 16.9 mm/sec. Coincidentally, the resistive elements in the thermal print head were pulsed on for 58 μsec every 76 μsec. Printing maximum density required 64 pulses "on" time per printed line of 5.0 msec. The voltage supplied at 13.6 volts resulted in an instantaneous peak power of approximately $58.18\times10^{-3}$ Watt/dot and the maximum total energy required to print Dmax was 0.216 mJoules/dot. This printing process heated the laminate uniformly with the thermal head to permanently adhere the laminate to the print. The donor support was peeled away as the printer advanced through its heating cycle, leaving the laminate adhered to the imaged receiver.

The blue density of the yellow step tablet and the green density of the magenta step tablet was measured using an X-Rite Densitometer 820. The elements were then exposed to high intensity sunlight, 50 Klux xenon arc lamp, for two weeks in an incubation chamber. The elements were then removed from the incubation chamber and the density was reread, and the density loss was calculated. The following results were obtained:

TABLE

| Element | Colloidal Silica (g/m$^2$) | TiO2, ZrO2 and SnO2* (g/m$^2$) | Antimony Pentoxide (g/m$^2$) | % Density Loss Blue | % Density Loss Green |
|---|---|---|---|---|---|
| 1 | 0 | 0 | 0.12 | 0 | 0 |
| C-1 | 0.12 | 0 | 0 | 70 | 53 |
| C-2 | 0 | 0.12 | 0 | 65 | 50 |

The above results show that the elements of the invention containing antimony pentoxide had much less density loss than the control elements.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon at least one dye layer area comprising an image dye in a binder and another area comprising a transferable protection layer, said transferable protection layer area being approximately equal in size to said dye layer area, wherein said transferable protection layer comprises a binder and a UV-absorber comprising an oxide of antimony.

2. The element of claim 1 wherein said oxide of antimony is antimony pentoxide.

3. The element of claim 1 wherein said dye-donor element is a multicolor element comprising repeating color patches of yellow, magenta and cyan image dyes, respectively, dispersed in a binder, and a patch containing said protection layer.

4. The element of claim 1 wherein said protection layer also contains inorganic particles.

5. The element of claim 1 wherein said binder of said protection layer is poly(vinyl acetal).

6. The element of claim 1 wherein said protection layer contains from about 5% to about 60% by weight inorganic particles, from about 25% to about 60% by weight polymeric binder and from about 2% to about 60% by weight of antimony pentoxide.

7. A process of forming a protection layer on top of a thermal dye transfer image comprising:

(a) imagewise-heating a dye-donor element comprising a support having thereon a dye layer comprising an image dye in a binder, said dye-donor being in contact with a dye-receiving element, thereby transferring a dye image to an image-receiving layer of said dye-receiving element to form said dye transfer image; and (b) thermally transferring a protection layer on top of said transferred dye image, said protection layer being applied from an element which comprises a binder and a UV-absorber comprising an oxide of antimony.

8. The process of claim 7 wherein said oxide of antimony is antimony pentoxide.

9. The process of claim 7 wherein said dye-donor element is a multicolor element comprising repeating color patches of yellow, magenta and cyan image dyes, respectively, dispersed in a binder, and a patch containing said protection layer.

10. The process of claim 7 wherein said protection layer also contains inorganic particles.

11. The process of claim 7 wherein said binder of said protection layer is poly(vinyl acetal).

12. The process of claim 7 wherein said protection layer contains from about 5% to about 60% by weight inorganic particles, from about 25% to about 60% by weight polymeric binder and from about 2% to about 60% by weight of antimony pentoxide.

13. A thermal dye transfer assemblage comprising (a) a dye-donor element for thermal dye transfer comprising a support having thereon at least one dye layer area comprising an image dye in a binder and another area comprising a transferable protection layer, said transferable protection layer area being approximately equal in size to said dye layer area, wherein said transferable protection layer comprises a binder and a UV-absorber comprising an oxide of antimony; and (b) a dye-receiving element comprising a support having thereon said dye image-receiving layer, said dye-receiving element being in a superposed relationship with said dye-donor element so that said dye layer is in contact with said dye image-receiving layer.

14. The assemblage of claim 13 wherein said oxide of antimony is antimony pentoxide.

15. The assemblage of claim 13 wherein said dye-donor element is a multicolor element comprising repeating color patches of yellow, magenta and cyan image dyes, respectively, dispersed in a binder, and a patch containing said protection layer.

16. The assemblage of claim 13 wherein said protection layer also contains inorganic particles.

17. The assemblage of claim 13 wherein said binder of said protection layer is poly(vinyl acetal).

18. The assemblage of claim 13 wherein said protection layer contains from about 5% to about 60% by weight inorganic particles, from about 25% to about 60% by weight polymeric binder and from about 2% to about 60% by weight of antimony pentoxide.

* * * * *